US011047117B2

(12) United States Patent
Biju-Duval

(10) Patent No.: US 11,047,117 B2
(45) Date of Patent: Jun. 29, 2021

(54) DEVICE FORMING A SHOWER PANEL AND METHOD FOR FITTING A DEVICE FORMING A SHOWER PANEL

(71) Applicant: LES ROBINETS PRESTO, Montrouge (FR)

(72) Inventor: Remi Biju-Duval, Saint-Georges-de-Didonne (FR)

(73) Assignee: Les Robinets Presto, Montrouge (FR)

( * ) Notice: Subject to any disclaimer, the term of this patent is extended or adjusted under 35 U.S.C. 154(b) by 0 days.

(21) Appl. No.: 16/343,530

(22) PCT Filed: Oct. 19, 2017

(86) PCT No.: PCT/EP2017/076787
§ 371 (c)(1),
(2) Date: Apr. 19, 2019

(87) PCT Pub. No.: WO2018/073383
PCT Pub. Date: Apr. 26, 2018

(65) Prior Publication Data

US 2019/0316332 A1 Oct. 17, 2019

(30) Foreign Application Priority Data

Oct. 20, 2016 (FR) ..... 16 70617
Oct. 19, 2017 (WO) ..... PCT/EP2017/076787

(51) Int. Cl.
*E03C 1/04* (2006.01)

(52) U.S. Cl.
CPC ..... *E03C 1/0408* (2013.01)

(58) Field of Classification Search
CPC ..... E03C 1/0408
USPC ..... 4/614, 612
See application file for complete search history.

(56) References Cited

U.S. PATENT DOCUMENTS 3,333,284 A 8/1967 Symmons

FOREIGN PATENT DOCUMENTS

EP 1 950 355 A2 7/2008 ..... E03C 1/02
WO WO 93/08724 5/1993 ..... A47K 3/22

OTHER PUBLICATIONS

International Search Report dated Jan. 16, 2018 in related application No. PCT/EP2017/076787.

*Primary Examiner* — Lori L Baker
(74) *Attorney, Agent, or Firm* — Renner Kenner Greive Bobak Taylor & Weber Co. LPA

(57) ABSTRACT

Method for fitting a shower panel, notably for communal use, intended to be surface-mounted on a wall, comprising a housing (1), of U-shaped cross section defining, between its opening and at least one front wall (2), an interior space housing the shower controls, notably on a timer, and the pipes or ducts for connecting the hot and/or cold water inlets, the controls and at least one main water outlet, notably fitted with a shower head, and at least one element for supporting the panel on the wall, which element is intended to be fixed to the wall, for example two cross-members—an upper one and a lower one—and characterised in that it comprises the following steps: the support is fixed to the wall; then the U-shaped housing is fixed to the support and the interior space is closed.

13 Claims, 8 Drawing Sheets

FIG.9A
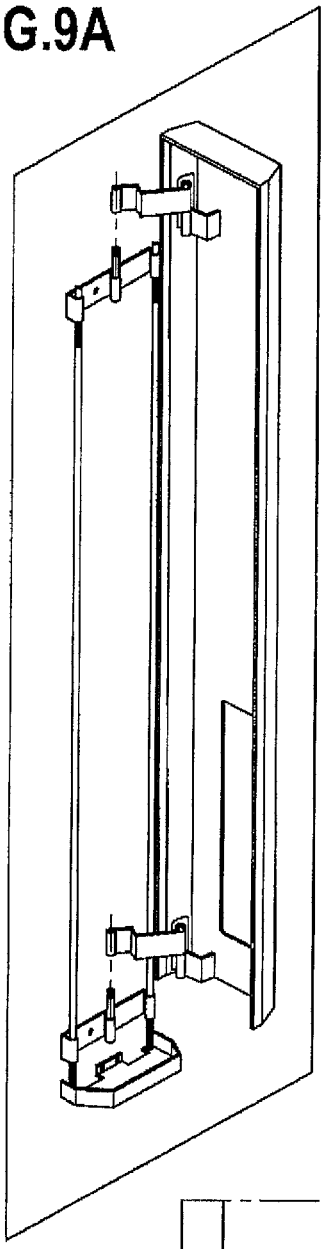
FIG.9B
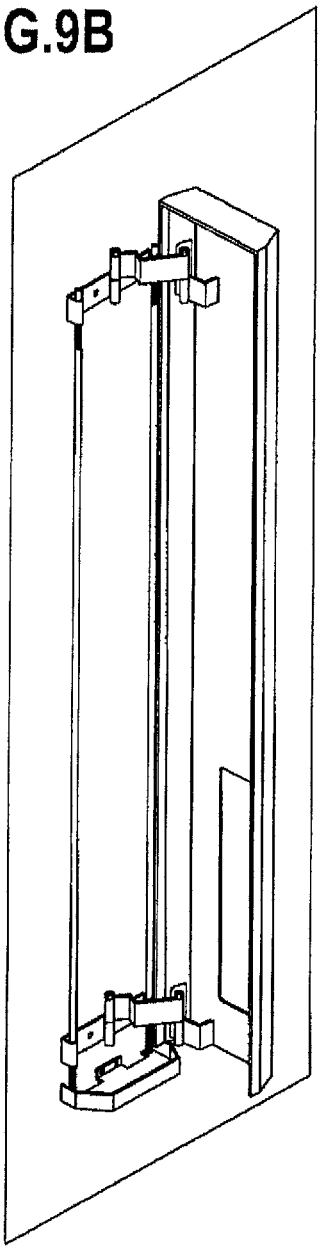
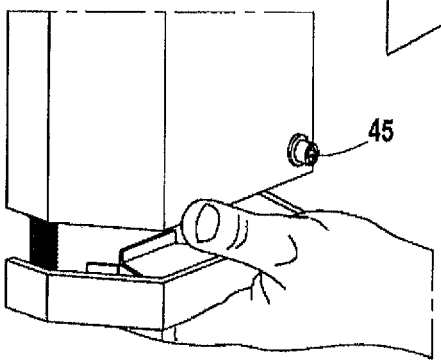
FIG.9C

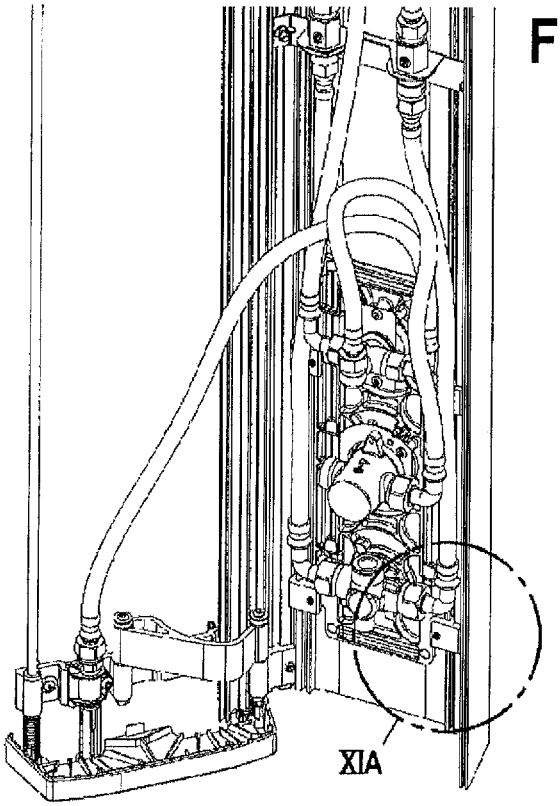
FIG.11
FIG.11A
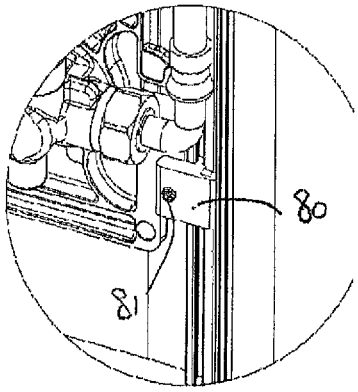
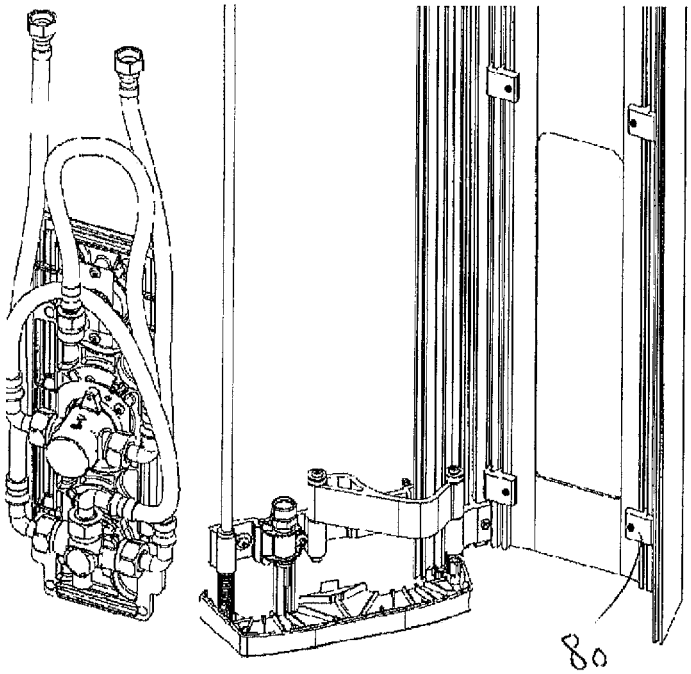
FIG.12

DEVICE FORMING A SHOWER PANEL AND METHOD FOR FITTING A DEVICE FORMING A SHOWER PANEL

CROSS-REFERENCE TO RELATED APPLICATION

This is a § 371 application of International patent application number PCT/EP2017/076787 filed Oct. 19, 2017, which claims the benefit of French patent application FR 16 70617 filed on Oct. 20, 2016.

TECHNICAL FIELD

The present invention relates to a device forming a panel or surface-mounted shower, notably for communal use, and a method for fitting a device forming a shower panel and a shower comprising a panel or surface-mounted shower.

BACKGROUND ART

Classically, a shower panel consists of a panel in the form of a essentially parallelepipedic rectangular housing for surface-mounting on a wall to form a shower, a shower head projecting from the top of a front face of the housing, while at the bottom are the shower controls, for example knobs for adjusting the temperature, selecting the main shower or hand shower and the time delay control, with connecting pipes running between the controls and the shower head and the hand shower and between the controls and the hot/cold water inlets entering the housing.

Panels of this type are well known from the prior art, for example in U.S. Pat. No. 3,333,284 or EP 1 950 355. The panels are mounted directly on the wall, notably by means of screws. The installation, notably the wall mounting, of the known panels is particularly difficult owing notably to the total weight of the panel consisting of the housing, the shower head and the controls, as well as the necessity of connecting the water inlet pipes and positioning them inside the front panel before mounting it. This particularly complicated mounting operation classically requires at least two people to carry it out. Similarly, when the panel requires repair, for example to replace a defective shower head or control knob, the operation is equally complicated, since it requires the panel to be removed than refitted. Finally, winter storage operations, for example for communal showers in camps, require the panels to be removed at the end of the summer season, stored during the winter and refitted at the start of the season, which involves firstly complicated operations both for removing and refitting and secondly providing space to store them.

A shower panel according to the preamble of claim 4 is known in WO 93/08724.

SUMMARY OF THE INVENTION

The present invention aims to overcome these problems of the prior art by proposing a method for fitting a shower panel, notably for communal use, that permits simpler fitting and removal and a shower panel, notably for communal use, whose fitting and removal are particularly simplified compared with the devices of the prior art.

According to the invention, a method for fitting a shower panel, notably for communal use, intended for surface-mounting on a wall is as defined in claim 1.

According to one method of realisation, the U-shaped housing is fixed to the support, leaving the interior space accessible, the pipes or ducts leading to the hot and/or cold water inlets, notably on the back of the panel are connected, and the interior space is closed.

According to another method of implementation, the pipes or ducts to be connected to the hot and/or cold water inlets, notably at the top or bottom of the panel, are connected after closing the interior space.

According to an advantageous aspect of the invention, a shower panel, notably for communal use, intended to be surface-mounted on a wall is as defined in claim 4, improvements being defined in sub-claims 5 to 13.

According to a preferred method of implementation of the invention, the open housing is able to rotate by means of at least one hinge, notably two hinges, a lower one and an upper one.

Preferably the at least one hinge comprises a first pin and a first bush respectively, connected to the support element and a second pin and a second bush respectively, connected to the housing and an intermediate element in the form of a plate comprising at its ends two bushes and two pins respectively, working together with the first and second pins and the first and second bushes respectively.

Preferably, the centre line of the first pin of the first bush respectively, is offset towards the interior of the housing with respect to the centre line of the second bush respectively, to permit, when the panel is mounted on the wall, a travel of greater than 90°, notably a travel of up to 160°, in spite of the U-shape of the housing.

In particular, the intermediate element in the form of a plate is curved, the concave side of the curve facing towards the interior space defined by the housing.

Preferably, the centre line of the second pin, of the second bush respectively, is essentially at the base of the housing, away from the opening edge.

According to a preferred method of implementation of the invention, the controls, for example the time delay knob, the temperature control knob, the lever for selecting the shower or hand shower, and their respective connection to the pipes leading to the water supply points and the shower head and/or the hand shower, are mounted together on a detachable element comprising an auxiliary plate forming a panel fitting into a corresponding opening formed in the front side of the housing, the auxiliary plate being easily removable, notably for winter storage.

According to another advantageous aspect of the invention, independent of the aspect previously mentioned, which can advantageously be implemented in combination for surface-mounting on a wall, comprising a housing, with a U-shaped section defining an interior space between its opening and at least one front side, containing the shower controls, notably on a time delay, and the pipes or ducts connecting the hot and/or cold water inlets, the controls and at least one main water outlet, notably equipped with a surface-mounted wall panel, for example two cross-members, an upper one and a lower one, characterised in that the open housing can rotate with respect to the at least one support element, the support element comprising a supporting frame consisting of two cross-members, an upper and a lower one and two vertical rods that can slide with respect to the two cross-members.

Preferably, a lower cover fitting the lower edge of the housing is mounted on the frame, notably at the ends of the two rods, so that when the housing is mounted on the frame, the housing is closed at the bottom by the lower cover Preferably, the housing includes an upper cover that closes the top of the housing.

Preferably, at least one rod of the frame works together with at least one respective blind bush formed in the housing to prevent rotation of the housing.

The present invention also relates to a detachable control element or panel comprising only one baseplate and the controls, for example a mixer, a three-way valve and a tap on a timer, parts to actuate the controls, for example a rotary knob to adjust the temperature, a main shower or hand shower selection lever and a timer handle projecting from a first exterior face of the plate and connecting parts for the associated controls for connecting the pipes/ducts to the hot or cold water supply to the shower head, the hand shower and similarly those projecting from a second interior face of the plate.

The control panel (which can also be in the form of a closed housing or box including simply output orifices for the pipes) containing all the shower panel controls can thus be replaced when a control element is faulty or when it is desired to upgrade the shower panel. In addition, during the installation of a panel according to the invention, the cassette can only be positioned after installation of the U-section of the panel, which decreases the weight to be carried still more when fitting the U-section to the wall mounting bracket.

According to a preferred method of implementation, the plate comprises at least one flange, preferably a peripheral stepped flange all around the plate so that, when the plate of the detachable part is inserted into an opening of a matching shape formed in the front side of a shower panel, the flange butts against the inner edge of the opening.

Access to the controls is thus only possible from inside the shower panel, which protects them against attempted theft and/or "dismantling" or damage.

Preferably, the plate is fixed to the front side at at least one flange.

According to one method of implementation, pipes or ducts are connected at one end to a respective connector fitted to the inner face of the detachable part and whose other end is intended to be connected to the water supply points and the shower head and/or the hand shower.

BRIEF DESCRIPTION OF THE DRAWINGS

As an example simply intended to illustrate the invention, a preferred method of implementation of the invention is described by referring to the drawings, in which:

FIG. 8 is a perspective view of the front of the lower part of the panel in FIG. 1 in an intermediate position, while

FIGS. 9A, 9B and 9C are perspective views showing the steps for mounting the panel on the wall;

FIG. 11 is a view of the bottom of the panel in FIG. 1 or 10;

FIG. 11A is an expanded view of the part A encircled in FIG. 11; and

FIG. 12 is an exploded view of the lower part of FIG. 11, the control panel being shown away from the opening in the front side that receives it.

BEST MODE FOR CARRYING OUT THE INVENTION

Figure 1:
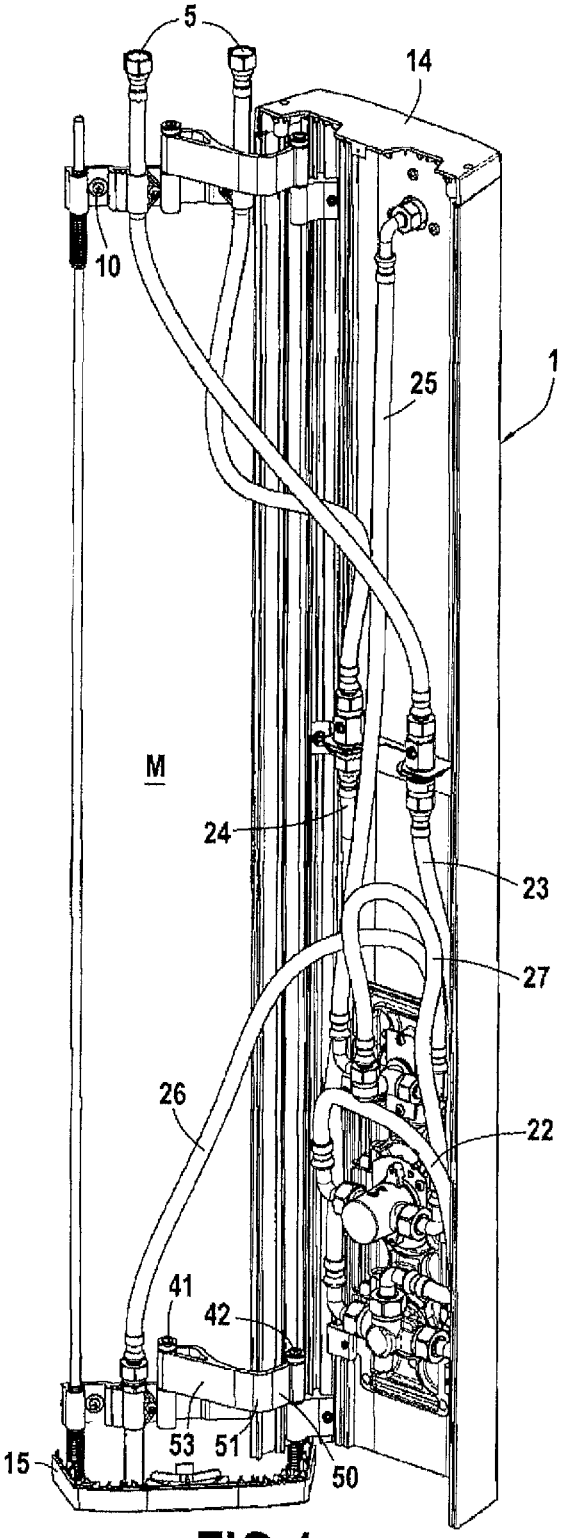
FIG. 1 is a perspective view of the open state of s shower panel according to one method of implementation of the invention, the panel being fixed to the wall.
Figure 2:
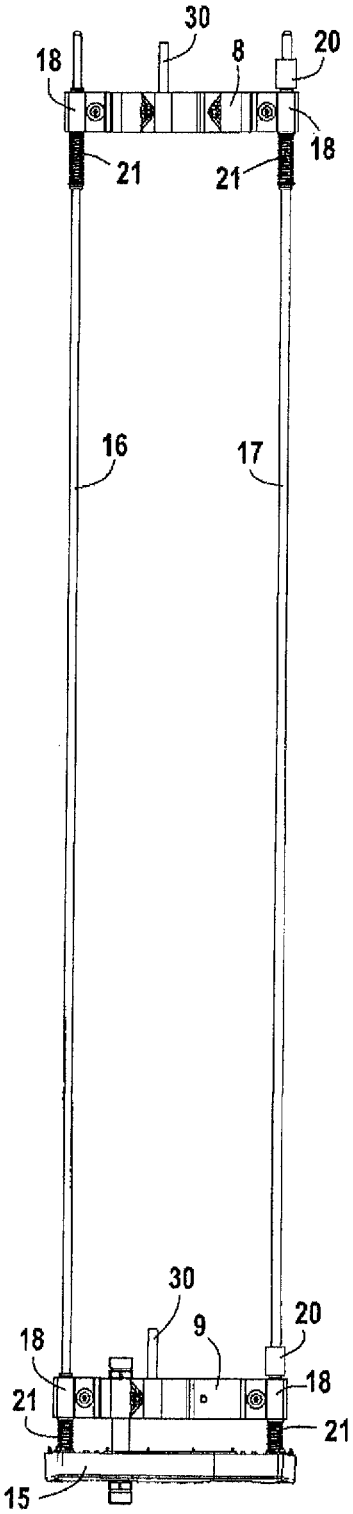
FIG. 2 is a front view of the part forming the support element of the shower panel housing in FIG. 1, the housing not being shown.
Figure 3:
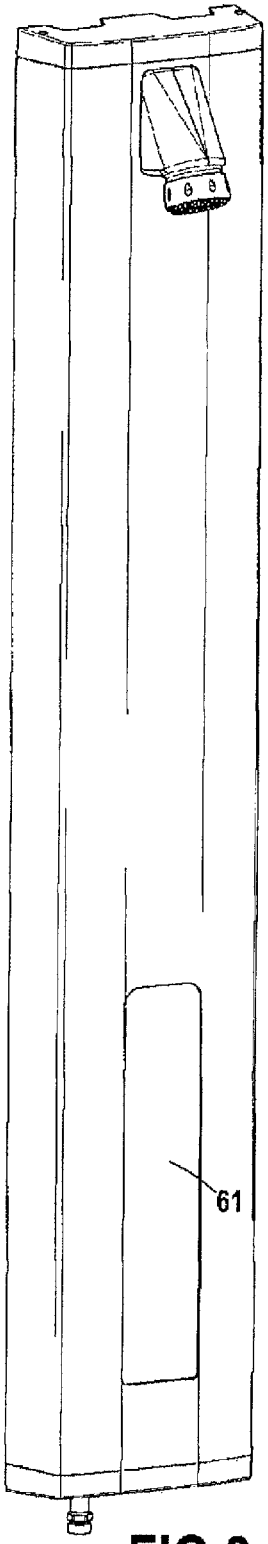
FIG. 3 is a front perspective view of the panel housing of FIG. 1, with the auxiliary plate forming the control box omitted.
Figure 6:
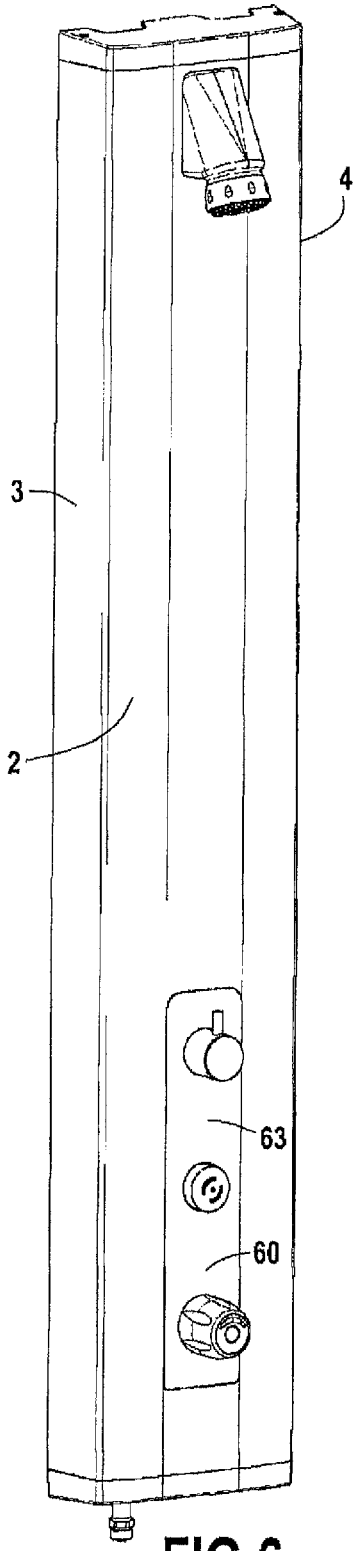
FIG. 6 is a front perspective view of the complete housing, that is to say with the control box flush-mounted in the frontal opening.

FIG. 1 shows a shower panel according to the invention mounted on a vertical wall M. The shower panel includes an essentially rectangular housing 1 open at the back and with a front side 2 and two left and right sides 3 and 4. The housing 1 thus defines between sides 2, 3 and 4 an interior open space on the wall side which contains the shower controls and the pipes 22, 23, 24, 25, 26 and 27 connecting between the hot and cold water supplies 5 and 6, the main shower head and the hand shower respectively and the mixer 28, the timer 29 and the lever 30 for selecting either the shower (up) or the hand shower (down).

The shower panel also includes two cross-members 8 and 9 in the form of an upper and a lower plate respectively, which are fixed to the wall M with screws 10.

The housing 1 includes a part 14 forming an upper cover that closes the interior space defined by the front housing 1 at the top, the top being fixed to the upper edges with screws. According to another possible method of implementation, the top cover 14 can form part of the sides 2, 3 and 4.

The two cross-members 8 and 9 also form a supporting frame with the two vertical cylindrical rods 16 and 17, the rods being able to slide with respect to the two cross-members 8 and 9 by passing through the bushes 18 respectively. A lower cover 15 shaped to close the housing 1 at the bottom is fixed to the lower ends of the rods 16 and 17.

Figure 8:
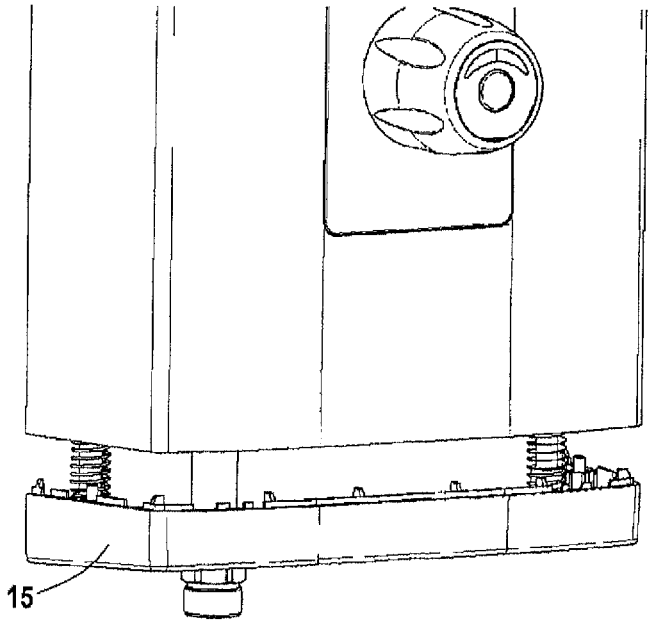
Figure 8A:
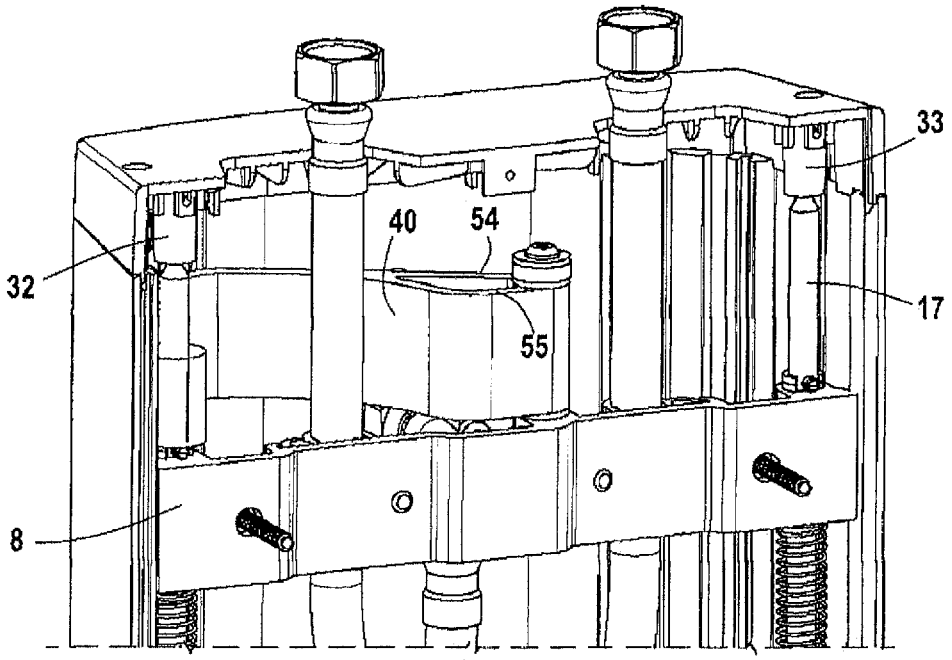
FIGS. 8A and 8B are views of the rear of the lower part and top part of the panel respectively in the intermediate position shown in FIG. 8.
Figure 8B:
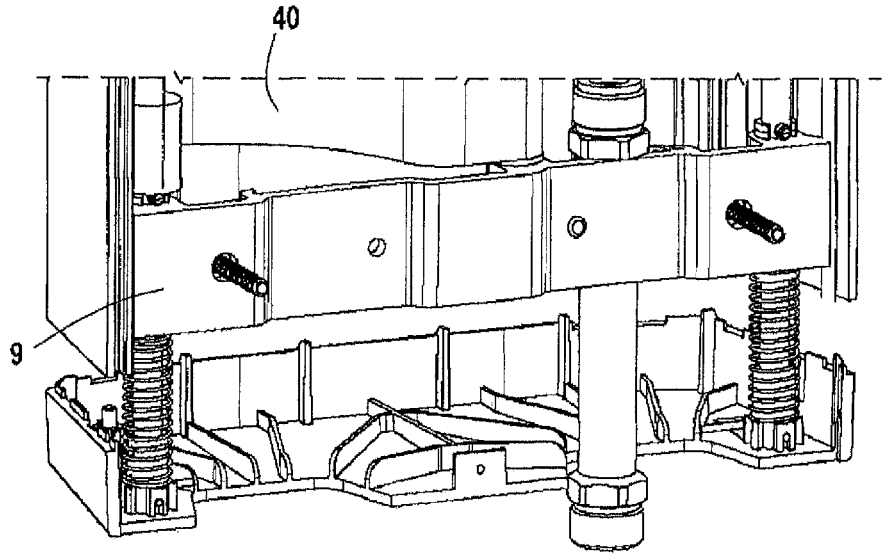

Two stops 20 are incorporated in the rod 17 and prevent it from moving downwards beyond a certain limit. Secondly, springs 21 are fitted along the rods 16 and 17 between the lower cross-member 9 and the lower cover 15 attached to the rods 16 and 17. The rods 16 and 17 project beyond the upper cross-member 8 to work with the upper cover 14. The rods 16 and 17 that work with the upper and lower covers 14 and 15 can be seen notably in FIGS. 8, 8A and 8B. Two blind bushes 32 and 33 project from the underside or interior of the cover 14, the upper ends of the rods 16 and 17 can be inserted into the bushes 32 and 33 by pushing the lower cover 15 upwards, against the force of the springs 21.

Therefore, once the housing 1 has been rotated with respect to the position in FIG. 1 to a position that places it parallel to the wall M, so that the lower edges of sides 2, 3 and 4 of the housing 1 meet the upper edge of the lower cover 15, the installer can apply an upward pressure to the lower cover 15 against the force of the springs to cause the rods to slide upwards so that the upper ends of the rods 16 and 17 enter the blind bushes 32 and 33 until the upper edge of the lower cover 15 comes into contact with the lower edges of the sides 2, 3 and 4 of the housing 1, The panel can then be locked in its operating position by means of a screw 45. When the screw 45 is unscrewed, the springs 21 return to the bottom of the rods 16 and 17, so that their ends leave the blind bushes 32 and 33, thereby freeing the housing so that it can be opened by rotation.

As can be seen in the diagrams, the open housing 1, consisting of the front side 2, the lateral plates 3 and 4 of the upper cover 14, can turn like a hinge on the two support elements 8 and 9 in the form of cross-members that are fixed to the wall M.

Two upper and lower cylindrical pins 30 project vertically from the two cross-members 8 and 9 respectively to work with an upper and lower intermediate element 40 respectively. Each intermediate element 40 is in the form of a curved plate including at each end a respective central bush 41 and a lateral bush 42. The central bush 41 engages with the pin 30 projecting from the cross-member 8, 9, while the lateral bush 42 engages with a lateral pin 43 built into the housing 2.

The lateral pin 43 is located inside the housing, close to the corner formed by the front 2 and the right lateral side 4. The intermediate plate 40 is curved. It comprises a lateral section 50 extending from the lateral bush 42 to the bend 51, then a central section 52 that extends from the bend 51 to the central bush 41. The central section 52 has a Y-shaped section, comprising a lower part 53 whose cross section increases progressively finally dividing into two forks 54 and 55, each extending to the lateral bush 42. This Y-shaped central section strengthens the hinge which has to bear the weight of the housing and the parts that it contains, The circular shape and/or the offset of the two central and lateral pins respectively ensure that the housing can rotate more than 90° before the right lateral side comes into contact with the wall M, in particular a rotation of the order of 160°, which greatly simplifies installation. In particular, as can be seen in the diagrams, the two central pins 30 project from the cross-members 8 and 9 essentially at the centre of the two cross-members.

Installation of a panel according to the invention, as shown above, is particularly simple.

The user first positions the wall frame consisting of the cross-members 8 and 9, the two rods 16 and 17 and the lower cover 15 on the wall M by classical methods, notably by screwing it to the wall with the screws 10. He then offers up the rest of the panel, namely the housing 1, and fits it by engaging the two pins 30 with the bushes 41 of the hinges 40. He can then connect the various pipes to their respective connectors, either at the top and bottom of the housing (as shown in the diagrams) or, according to another method of implementation, at the back of the housing. In addition, he can fit the housing 1, either without the control panel 60, or with the latter previously mounted on the panel. In fact, the control panel 60 is fitted so that it can be removed through an opening 61 formed in the front 2 of the housing, so that he can add it after installing the panel, which simplifies installation even more because the panel is much lighter to hold while positioning it on the wall. With the panel fitted to the wall frame with the hinge, the control panel installed in the panel and the pipes connected, the installer only has to rotate the housing 1 to mate it with the lower cover 15, then push the panel 15 upwards to cause the rods 16 and 17 to slide upwards so that they enter the corresponding blind bushes in the upper cover 14 and also the sides 2, 3 and 4 of the housing butt against the upper edge of the lower cover 15 to prevent any possibility of rotation of the housing which can then be finally locked by means of the screw 25. The housing, or the lower interior space defined by the U-section and the wall, is thus closed.

In the example above, the cylindrical pins projecting from the cross-members 8 and 9 that work with the bushes formed in the intermediate plate were described. It is clear that this can be done in reverse while remaining within the scope of the invention. It can also be done as described above for one of the intermediate elements and in reverse for the other intermediate element. One pin and one bush could also be provided on the intermediate element, rather than two pins or two bushes.

On the other hand, the connecting pipes are flexible hoses and make the following connections:

Pipe 22: connection between the mixer 28 and the timed valve.

Pipe 23 or 24: hot or cold water connection with the mixer 28.

Pipe 25: connection between the selector 30 and the main water outlet to the shower head 7.

Pipe 26: connection between the selector 30 and the auxiliary water outlet to the hand shower (not shown).

Pipe 27: connection between the selector 30 and the timed valve 29.

Figure 7:
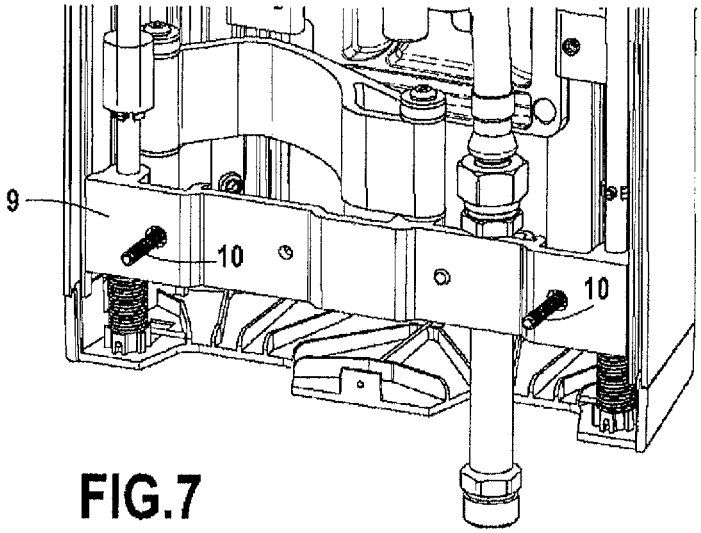
FIG. 7 is a perspective view of the front of the lower part of the panel in FIG. 1 in the closed or operating position, the wall having been omitted for clarity.

According to a preferred method of implementation of the invention, the materials and shape of the various parts constituting the panel, notably the frame, the housing and the hinges can be chosen so that in the open state of the housing (FIG. 1) the housing is inclined slightly with respect to the vertical defined by the rods of the frame, for example by an angle of between 1° and 5°. In the closed position (FIG. 7), the housing, fitted to the frame, is by contrast parallel to the vertical defined by the rods. This inclination gives improved stability of the housing when opened, notably improved resistance to stresses, thereby avoiding premature breakage of the hinges.

Figure 4:
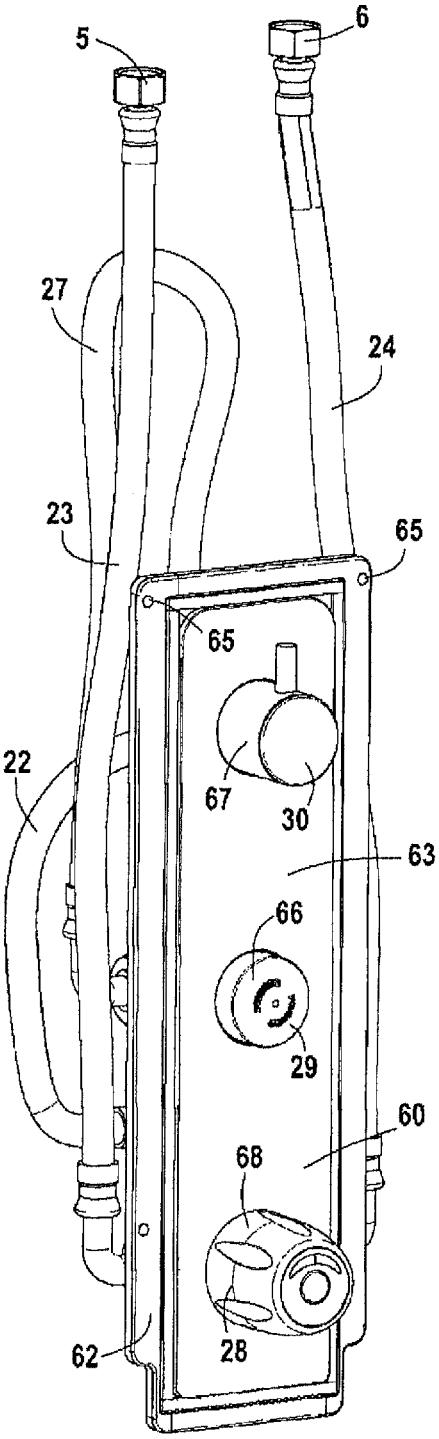
FIG. 4 is a front perspective view of the auxiliary plate forming the control box and associated connecting pipes for the panel in FIG. 1, intended to be recessed into the frontal opening formed in the front side of the housing in FIG. 3.
Figure 5:
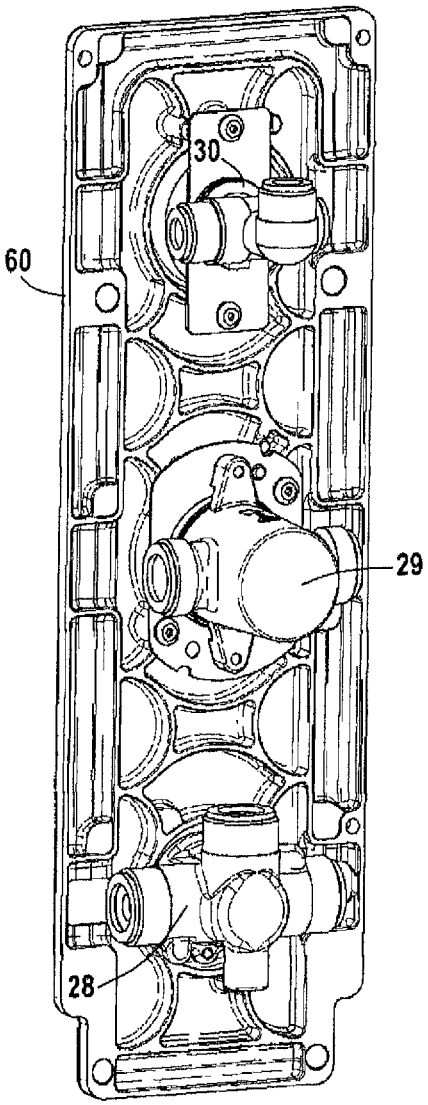
FIG. 5 is a rear view of the auxiliary plate forming the control box in FIG. 4, with the connecting pipes omitted.

FIGS. 4 and 5 show in detail a control panel according to the invention. The control panel 60 comprises a rectangular plate 63 of the same size as the opening 61, with a flange 62 extending essentially all around the plate 63. Therefore, when the control panel 60 is inserted from the interior of housing 1 into the opening 61, the plate 63 fits exactly into the opening while the surrounding flange 62 butts against the interior edge of the opening. Once the flange 62 is mated with the interior face of the front side 2 of the housing, the box is fixed to the front side with screws in the holes 65 formed in the flange 62 so that it can be removed.

From the exterior face of the plate 63 project the knob 66 of the shower timer valve 29, a lever 67, 30 for selecting either the main shower or the hand shower and a rotary knob for the mixer 28 for adjusting the temperature of the water.

The lever 67 and knob 68 project from the interior face of the plate 63, in correspondence with the knob 66, the rest of the timed valve, the three-way valve and the mixer, notably their respective connectors to be connected to pipes 22 to 27. One can imagine them being enclosed in an auxiliary protective housing or box. However, that is not a necessity.

Thus, only the activating controls are within the reach of the user and the latter cannot pull the control panel towards himself, because of the stop on the flange 62 against the interior edge of the opening 61. At the same time, it is very simple for the owner of the shower to replace a faulty control and/or replace the whole control panel, simply by removing it from the interior, after opening the housing 1.

Figure 10:
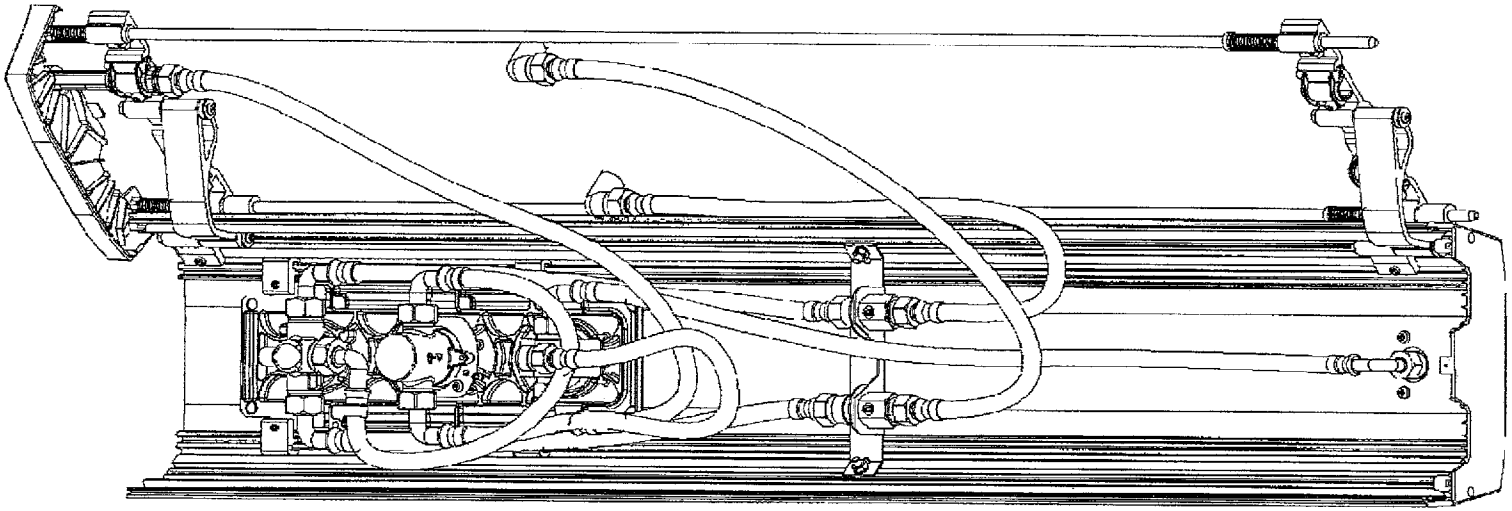
FIG. 10 is a view of the panel in FIG. 1 in which the connections of the hot and cold main water pipes are made from the rear of the panel, notably inside the support frame, while in FIG. 1 these connections are made at the top of the panel.

In FIG. 10, the pipes 23 and 24 to be connected to the main hot and cold water inlets are connected to the inputs on the wall at the back of the panel between the two cross-members, inside the frame. Once the U-shaped housing is fixed to the pins in the support frame and the connections to the mains are made, the housing is turned to close the interior space and is then in the working position In FIG. 1, the pipes 23 and 24 to be connected to the main hot and cold water inlets are fixed to the upper cross-member so that they project upwards from the panel, being fixed to permit their connection to the main water inlets. Once the U-shaped housing is fixed to the pins in the support frame and the fixings to the upper cross-member for connection to the mains have been made, the housing is rotated to close the interior space and it is then in the operating position.

FIGS. 11 and 11A show how the control panel is fixed to the front side. It is fixed by lugs 80 fixed to the interior face of the front side that press against the interior face of the control panel, so that the latter is sandwiched between the edge of the opening and the lugs. In addition, each lug comprises a screw 81 that when screwed against the control panel increase the compression force of the lugs against the control panel and therefore locks the latter in position.

The invention claimed is:

1. Method for fitting a shower panel, comprising a U-shaped housing, defining, between an opening and at least one front side, an interior space containing shower controls and pipes for connecting hot and/or cold water inlets to said shower controls and to at least one main outlet for the water, and at least one wall support element for supporting said shower panel characterised in that it includes the following steps:

the wall support element is fixed to a wall; then the U-shaped housing is fixed to the wall support element and the interior space is closed, said U-shaped housing being rotatable with respect to said wall support element by means of at least one hinge, and the at least one hinge includes a first pin and a respective first bush, integral with the wall support element and a second pin and a second respective bush, integral with the U-shaped housing and an intermediate element in the form of a plate having at two ends thereof two bushes and two respective pins, that engage with the first and second pins and the first and second bushes respectively, a centre line of the first pin and of the first respective bush being offset towards said interior space of the U-shaped housing with respect to the centre line of the second pin and of the second respective bush, so as to permit a rotation travel of greater than 90° of said U-shaped housing.

2. The method according to claim 1, characterised in that the U-shaped housing is fixed to the wall support element leaving the interior space accessible, the pipes to be connected to hot and/or cold water inlets are connected, and said interior space is closed.

3. The method according to claim 1, characterised in that the pipes to be connected to hot and/or cold water inlets are connected after closing said interior space.

4. Shower panel, comprising an open U-shaped housing, defining between an opening and at least one front side an interior space containing shower controls and pipes to connect hot and/or cold water inlets to said shower controls and to at least one main outlet for water and at least one wall support element, characterised in that the U-shaped housing is rotatable with respect to the at least one wall support element, the open U-shaped housing being rotatable on a hinge, and the at least one hinge comprises a first pin and a respective first bush, integral with the wall support element and a second pin and a respective second bush, integral with the U-shaped housing and an intermediate element in the form of a plate including at the ends thereof, two bushes and two respective pins, a centre line of the first pin and of the respective first bush being offset towards the interior of the U-shaped housing with respect to the centre line and the second pin of the respective second bush, so that the U-shaped housing can rotate more than 90°.

5. The shower panel according to claim 4, characterised in that the intermediate element in the form of a plate is curved, a concave side thereof facing towards the interior space defined by the U-shaped housing.

6. The shower panel according to claim 4, characterised in that the centre line of the second pin and the respective second bush, is at a bottom of the U-shaped housing, away from an edge of the opening.

7. The shower panel according to claim 4, characterised in that the shower controls and their respective connection to the pipes and to the hot and/or cold water inlets, and to the at least one main outlet, are mounted together on a detachable element comprising an auxiliary plate forming a control panel mounted in a corresponding opening formed in the front of the U-shaped housing.

8. The shower panel according to claim 4, characterised in that the wall support element comprises a support frame consisting of two horizontal cross-members, a lower one and an upper one, and two vertical rods that can slide with respect to the two cross-members.

9. The shower panel according to claim 8, characterised in that a lower cover fitting the lower edge of the U-shaped housing is fixed to the support frame so that when the U-shaped housing is mounted on the support frame, the U-shaped housing is closed at a bottom thereof by the lower cover.

10. The shower panel according to claim 4, characterised in that the U-shaped housing comprises an upper cover closing the U-shaped housing at a top thereof.

11. The shower panel according to claim 8, characterised in that at least one rod of the support frame engages with at least one respective blind bush formed in the U-shaped housing to prevent rotation of the U-shaped housing.

12. Shower panel for communal use, comprising a U-shaped housing having a front side from which at least one main water outlet projects, and defining an interior space containing at least a mixer and a timer valve and pipes for connecting a water supply means to said at least said mixer and timer valve and to said at least one main water outlet;

a base plate being provided, said base plate having an interior face and an exterior face;

at least a temperature adjusting knob for adjusting the water temperature and a valve control knob for controlling said timer valve projecting from said base exterior face; and connection elements for connecting said at least said mixer and timer valve and said at least one main water outlet to said pipes projecting from said base plate interior face, said U-shaped housing front side comprising an opening into which said base plate is removably received, and said at least one main water outlet projecting from said front side at a distance from said opening.

13. The shower panel according to claim 12, wherein said base plate includes a peripheral stepped flange all-around said base plate so that when said base plate is inserted into said opening, the peripheral stepped flange butts against an interior edge of the opening.

* * * * *